United States Patent [19]

Chun-cheng

[11] Patent Number: 4,947,921

[45] Date of Patent: Aug. 14, 1990

[54] LIFT LOCK AND TILT DEVICE FOR A VENETIAN BLIND

[75] Inventor: Huang Chun-cheng, Taipei, Taiwan

[73] Assignee: Teh Yor Industrial Co., Ltd., Taiwan

[21] Appl. No.: 449,976

[22] Filed: Dec. 13, 1989

[51] Int. Cl.[5] ..... E06B 9/38

[52] U.S. Cl. ..... 160/176.1; 160/178.2

[58] Field of Search ..... 160/168.1, 173, 176.1, 160/177, 178.1, 178.2, 115

[56] References Cited

U.S. PATENT DOCUMENTS

| | | | |
|---|---|---|---|
| 2,840,157 | 6/1958 | Lorentzen | 160/173 |
| 4,245,687 | 1/1981 | Vecchiarelli | 160/177 |
| 4,245,688 | 1/1981 | Vecchiarelli | 160/178.2 |
| 4,271,893 | 6/1981 | McCluskey | 160/178.1 |
| 4,327,797 | 5/1982 | Nakajima et al. | 160/178.2 X |
| 4,406,319 | 9/1983 | McNiel et al. | 160/177 |
| 4,522,245 | 6/1985 | Anderson | 160/177 |
| 4,541,468 | 9/1985 | Anderson | 160/177 |
| 4,667,723 | 5/1987 | Spangenberg | 160/178.2 |
| 4,676,292 | 6/1987 | Valle et al. | 160/176.1 |
| 4,719,955 | 1/1988 | Tachikawa et al. | 160/176.1 X |

FOREIGN PATENT DOCUMENTS

| | | | |
|---|---|---|---|
| 2157753 | 10/1985 | United Kingdom | 160/177 |

*Primary Examiner*—David M. Purol

[57] ABSTRACT

A lift lock component and a tilt device component for a venetian blind which are fitted into the headrail of the venetian blind. These components and the headrail are constructed and arranged so that the same venetian blind can be used in different situations. to meet the requirement of different operational positions simply with a minimum displacement of a few parts of the components.

8 Claims, 2 Drawing Sheets

LIFT LOCK AND TILT DEVICE FOR A VENETIAN BLIND

BACKGROUND OF THE INVENTION

This invention relates to an improvement of the components in the headrail of the venetian blind.

Conventionally, a venetian blind is provided in its headrail with a lift lock to set the lifting level of the slats as desired and a tilt device to adjust the tilt angle of the slats. A pair of lift cords are passed through the lift lock and a tilt wand is provided to actuate the worm gear in the tilt device. The lift cords and the tilt wand are suspended in front of the venetian blind for facilitating the operation thereof. In general, the operation will be optionally carried out at the right-hand or left-hand side with respect to the window to which the venetian blind is mounted. With a conventional venetian blind it is impossible to fulfill the requirement of this option, since the positions that the tilt device with the tilt wand and the lift lock with the lift cords are disposed cannot be changed as desired, unless another venetian blind with the tilt device and the lift lock in different positions is employed.

SUMMARY OF THE INVENTION

The object of this invention is to provide an improvement relating to the components in the headrail of the venetian blind in such a manner that the same venetian blind may be used in different situations to meet the requirement of different operational positions simply with minimum displacement of a few parts.

BRIEF DESCRIPTION OF THE DRAWINGS

The foregoing and other objects, features and advantages of the invention will be apparent from the following particular description of preferred embodiments of the invention as illustrated in the accompanying drawings, in which.

DETAILED DESCRIPTION

Figure 1:
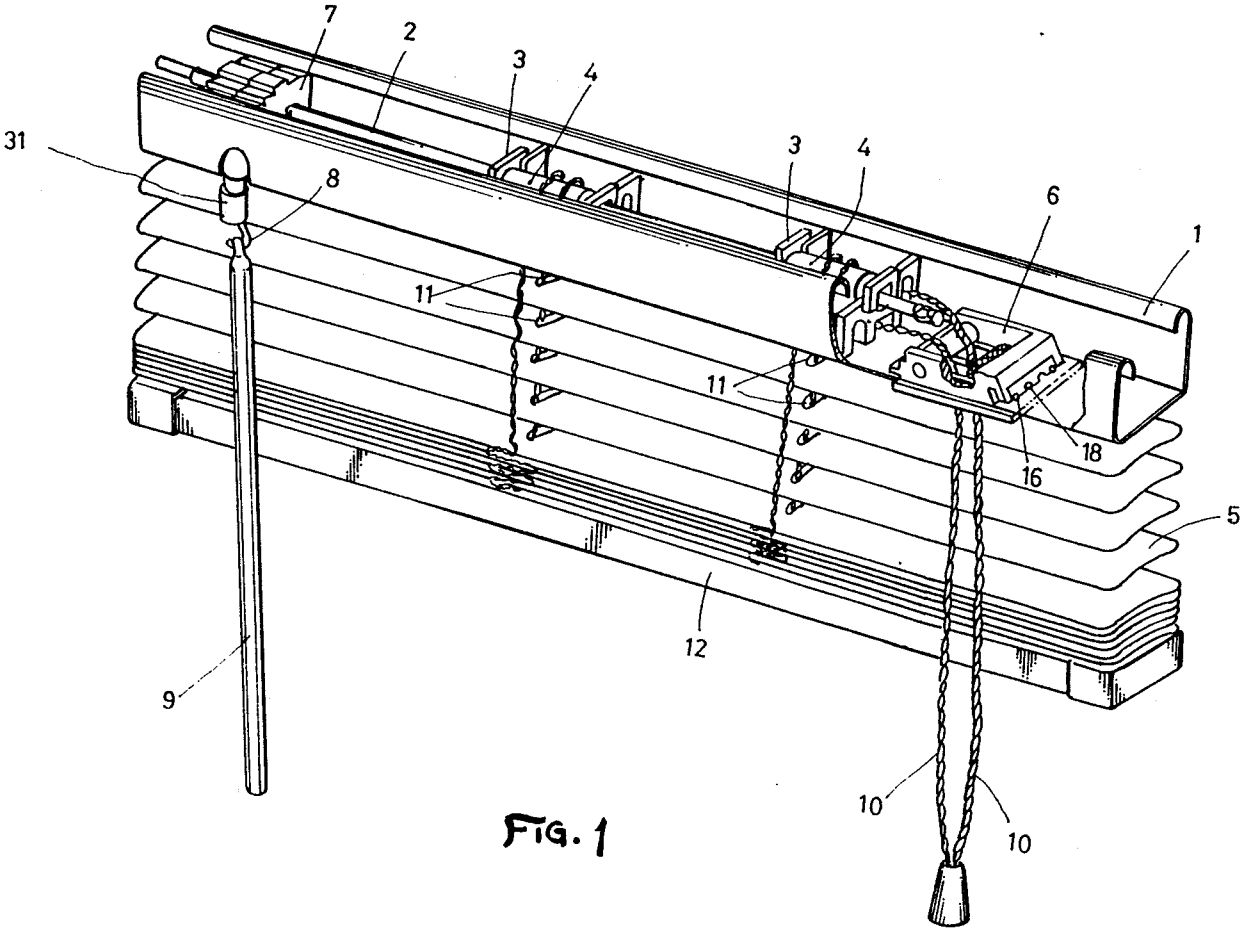
FIG. 1 is a schematic perspective new in general illustrating an embodiment of the improvement according to the present invention, partially broken away.

Now, reference is made to FIG. 1, which illustrates one embodiment of the venetian blind consisting of a headrail 1, a tilt tube 2, a pair of cradles 3, a pair of drums 4 and a plurality of slats 5, as conventional and hence the descriptions of their constructions and functions are omitted herein.

According to the present invention a novel lift lock 6 is fitted into the opening preformed at the bottom of said headrail 1 and a novel tilt device 7 is disposed in the headrail 1 with the hook end 8 protruded out of a preformed aperture at either side of the headrail 1.

As usual, a tilt wand 9 is engaged at the top end with said hook end 8, and a pair of lift cords 10 respectively passing through separate slots 11 in each slat 5 until connected at each one end to the support plate 12 is passed through the lift lock 6. Both tilt wand 9 and lift cords 10 are suspended in front of the venetian blind.

Figure 2:
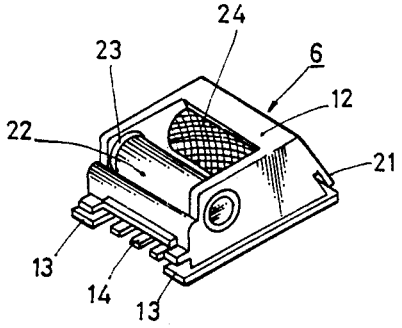
FIG. 2 is a perspective view of the lift lock component according to the present invention.
Figure 3:
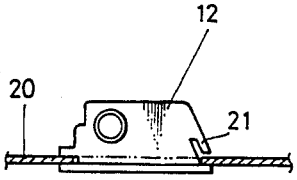
FIG. 3 is a lateral side view of FIG. 2, with a fragmentary bottom of the headrail in cross section.
Figure 4:
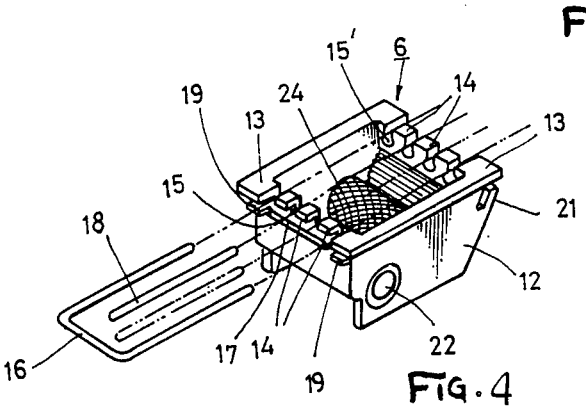
FIG. 4 is a perspective bottom view of FIG. 2, with the limit pins exploded.

FIG. 4, and also referred to FIG. 2, shows the lift lock 6 consisting of a housing 12 with respective forked flange 13 at its base and a plurality of teeth 14 within the limit of said flange 13 at both ends, e.g. three teeth as shown. So that there are formed inner notches 15 between adjacent teeth 14 to each other as well as outer notches 15' between side teeth 14 and the flange 13. A pin 16 bent in a U-shape is inserted with two leg portions into the outer notches 15' from one end through another end of the housing 12. At the near end of the housing 12, i.e. at the left lower end in FIG. 4, teeth 14 preferably overhang the support 17 to have a short distance just to receive the connecting portion of the U-shaped pin 16. Another pin 18 in the form of a straight bar is selectively inserted into either the inner notch 15 close to one lateral side at a position as shown by the solid line, or the inner notch 15 close to other lateral side of the housing 12 at a position as shown by two dot-and-dash lines. Two stop means 19 are porvided at both sides to have a short distance from said forked flange 13, to such an extent that this distance is just fitted onto the edge of the preformed opening at the bottom 20 of said headrail 1 when the lift lock 6 is mounted therein, as best seen in FIG. 3. At another end of the housing, i.e. right upper end in FIG. 4, a pair of tongues 21 are formed at opposite sides extending towards the base, having a function to retain the housing 12 on the bottom 20 of the headrail 1 at said end.

In the housing guide roll 22 with opposite inner flanges 23 is rotatably secured and a floating roll 24 serving as lock means is freely rotatably contained therein in parallel to said guide roll 22. Said floating roll 24 has a rough surface such as an embossed surface. The function and action of the lift lock 6 are just as in a conventional lift lock and thus omitted in further description.

In application said pin 16 will prevent the lift cords 10 from contact with the lateral side walls of the housing 12 to cause any friction and abrasion. When the venetian blind is to be installed with the lift lock 6 at the right hand side, in other words, the lift cords are operated at the right hand side, as shown in FIG. 1, with respect to the window, not shown, the pin 18 is inserted into the inner notch 15 close to the front side. Then the lift cords 10 are passed through the space defined between the pins 16 and 18, as referred to in FIG. 1. On the contrary, when the venetian blind would be installed with the lift lock 6 and thus the lift cords 10 at the left hand side, one only has to change the pin 18 to another inner notch 15 close the rear side and confine the lift cords into the new space between the pin 16 and pin 18 in the new location, then turn around the venetian blind whole set including the headrail 1 and all slats 5. Now, the lift cords 10 can be operated at the left hand side with respect to the window.

Figure 5:
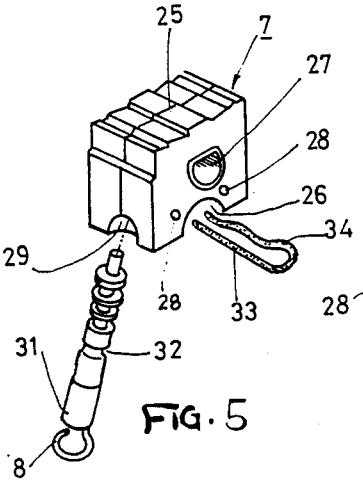
FIG. 5 is a perspective view of the tilt device component according to the present invention in exploded state.
Figure 6:
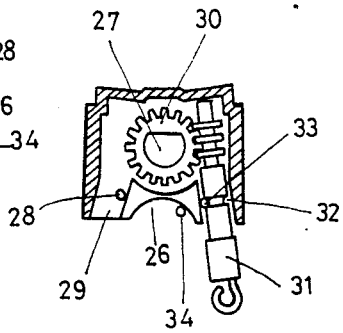
FIG. 6 is a side view of FIG. 5 in combination state, in partial cross section.

As illustrated in FIGS. 5 and 6, the tilt device 7 according to the present invention is composed of two halves to make a central meeting line 25 and a bottom arch 26. In combination a D-shaped opening 27 and two holes 28 at below said opening 27 in the proximity of said arch 26 are extended axially through the device 7. Two opposite slightly inclined passages 29 are extended radially. The D-shape opening 27 is also passed through the worm gear 30 for the tilt tube 2 passing therethrough. The worm 31 with hook end 8 is meshed at its top portion with said worm gear 30 and formed with an annular groove 32 at an intermediate portion. A clip with one straight leg 33 and another curved leg 34 is provided. When the clip is set with its straight leg 33 releaseably inserted into one of the holes 28 passing by the annular groove 32 of the worm 33 and its curved leg 34 clamped on the bottom arch 26, then the worm 31 is retained in the corresponding passage 29 in engagement with the worm gear 30.

When the venetian blind is installed with the tilt device 7 at the left hand side, in other words, the tilt wand 9 is operated at the left hand side, as shown in FIG. 1, with respect to the window, not shown, the worm 31 with hook end 8 is projected out of the preformed aperture at the front side of the headrail 1. On the contrary, when the venetian blind is to be installed with the tilt device 7 and thus the tilt wand 9 at the right hand side, one only has to pull out the clip, take out the worm 31 and re-insert it from the preformed aperture at another side, i.e. the rear side of the headrail 1 into another passage 29, then insert the clip back to retain the worm 31. Now, the venetian blind whole set including the headrail 1 and all slats 5 may be turned around. Thereby, the tilt wand 9 can be operated at the right hand side with respect to the window.

In the embodiment as illustrated the tilt wand 9 and the lift cords 10 are disposed at opposite ends of the venetian blind, but not limited here. For example, both tilt wand 9 and lift cords 10 may be disposed at the same end too.

While the invention has been particularly shown and described above with respect to preferred embodiment, the foregoing and other changes in form and detail may be made therein by one skilled in the art without departing from the spirit and the scope of the invention.

What I claim is:

1. In a venetian blind having a headrail with an opening at a bottom thereof and a lift lock component fitted in said opening, said lift lock comprising a housing having a forked flange at a base thereof and a plurality of teeth between the ends of said flange, whereby to form inner notches between adjacent teeth as well as outer notches between each side tooth and said flange, a first pin bent into a U-shape and having two legs inserted into said outer notches from one end of said housing through another end thereof, a second straight pin selectively inserted into either one of said inner notches adjacent to one lateral side or another of said inner notches adjacent to the other lateral side of said housing, a guide roll rotatably secured on said housing, and a floating roll having a rough surface freely rotatably contained in said housing.

2. In a venetian blind according to claim 1, wherein said guide roll is formed with opposite inner flanges.

3. In a venetian blind according to claim 1, wherein said floating roll has an embossed surface.

4. In a venetian blind according to claim 1, wherein a support is provided at one end of said housing and said teeth at said one end overhang said support to provide a space to receive a portion of said first pin which connects said two legs thereof.

5. In a venetian blind according to claim 1, wherein stop means are provided at both sides of said housing at a distance from said forked flange to provide a space for fitting said housing onto an edge of said opening at the bottom of said headrail.

6. In a venetian blind according to claim 4, wherein at the other end of said housing a pair of tongues are formed at opposite sides thereof and which extend toward said base of said housing to retain said housing on said bottom of said headrail.

7. In a venetian blind according to claim 1, wherein said headrail has two apertures at both sides thereof and a tilt device component, said tilt device component comprising a bottom arch, a worm gear, a D-shaped opening through said worm gear, a pair of holes extending axially through said tilt device belwo said D-shaped opening in the proximity of said bottom arch, a pair of slightly inclined passages extending radially in said tile device, a worm having a hook end inserted into one of said passages and meshed at a top portion thereof with said worm gear, said worm being formed with an annular groove at an intermediate portion thereof, and a clip having one straight leg and another curved leg, said straight leg being releasably inserted into one of said holes and passing by said annular groove of said worm, and said curved leg being clamped on said bottom arch.

8. In a venetian blind according to claim 7, wherein said tilt device is composed of two halves.

* * * * *